United States Patent [19]

Brower

[11] Patent Number: 4,600,860

[45] Date of Patent: Jul. 15, 1986

[54] RAPID-START FLUORESCENT LAMP CLOSURE SWITCH

[75] Inventor: Boyd G. Brower, Williamsport, Pa.

[73] Assignee: GTE Products Corporation, Stamford, Conn.

[21] Appl. No.: 818,997

[22] Filed: Jan. 13, 1986

Related U.S. Application Data

[63] Continuation-in-part of Ser. No. 582,671, Feb. 23, 1984, abandoned.

[51] Int. Cl.[4] ..... H01J 7/44

[52] U.S. Cl. ..... 315/73; 315/74; 315/104; 315/106; 315/107; 337/31

[58] Field of Search ..... 315/50, 73, 74, 106, 315/107, 104; 337/31

[56] References Cited

U.S. PATENT DOCUMENTS

| | | | |
|---|---|---|---|
| 2,464,704 | 3/1949 | Martin et al. | 315/104 |
| 2,492,575 | 12/1949 | Jacobsen | 315/106 |
| 3,679,932 | 7/1972 | Murphy | 315/106 |
| 4,052,687 | 10/1974 | Kimball | 337/25 |
| 4,097,779 | 6/1978 | Latassa et al. | 315/106 |
| 4,156,831 | 5/1979 | Cassidy et al. | 315/106 |
| 4,329,621 | 5/1982 | Barakitis | 315/106 |

*Primary Examiner*—Harold Dixon

*Attorney, Agent, or Firm*—Carlo S. Bessone

[57] ABSTRACT

A rapid-start fluorescent lamp has a thermally-sensitive circuit breaker disposed thereon for disconnecting the electrodes of the lamp from an energizing source at a given range of bulb temperatures and for connecting the electrode to the energizing source at bulb temperatures above and below the given range of bulb temperatures whereby the electrodes are energized during lamp manufacture and until conductivity of the lamp is established.

11 Claims, 4 Drawing Figures

RAPID-START FLUORESCENT LAMP CLOSURE SWITCH

This application is a continuation-in-part, of application Ser. No. 582,671, filed Feb. 23, 1984, now abandoned.

CROSS REFERENCE TO OTHER APPLICATIONS

The following applications relate to rapid-start fluorescent lamps and bimetal type circuit breakers especially suitable to such lamps: U.S. Ser. Nos. 520,866; 520,865; 520,861; 520,863; 520,862; 582,673; and 582,672.

TECHNICAL FIELD

This invention relates to bimetal type circuit breakers suitable for uses with rapid-start fluorescent lamps and more particularly to bimetal type circuit breakers for effecting heater current flow in rapid-start fluorescent lamps below and above a given range of bottle temperatures.

BACKGROUND ART

Generally, the two common forms of fluorescent lamps are the so-called"preheat" type and the"rapid-start" type. The "preheat" type of fluorescent lamp has heater current flow therethrough during lamp ignition and thereafter a voltage-sensitive starter, external of the lamp, opens and discontinues the above-mentioned heater current flow. However the"rapid-start" type of fluorescent lamp normally has current flow through each electrode not only during ignition but also during the operational period of the lamp. Thus, it can readily be seen that this continuous flow of heater current during operation of the rapid-start lamp is a cause for power loss in the system and an obvious and undesired cause for reduced operational efficiency.

In an effort to improve the energy efficiency of rapid-start fluorescent lamps, numerous suggestions and structural configurations have been suggested. For example, U.S. Pat. Nos. 4,052,687; 4,097,779; 4,114,968; 4,156,831 and 4,171,519; all of which are assigned to the assignee of the present application, provide numerous configurations for enhancing the operation of rapid-start fluorescent lamps. Primarily, each of the above-listed patents relates to rapid-start fluorescent lamps or bimetal type circuit breakers for fluorescent lamps whereby heater current flow is discontinued during lamp operation.

Although each one of the above-listed structures and techniques enchances and provides numerous advantages over prior known configurations and processes, it has been found that problems remain. More specifically, it has been found that bimetal type circuit breakers ordinarily require an electrical shunting material short-circuiting the leads of the circuit breaker during the rapid-start fluorescent lamp manufacturing process. During lamp processing, the circuit breaker is subjected to temperatures sufficiently high (about 300° C.) which maintains the circuit breaker open. Since the electrode of the fluorescent lamp includes a coating which require activation during lamp manufacture, it is necessary for the electrode to be electrically heated by electrode current therethrough during this time. Therefore, it has been found necessary to provide a means for essentially removing the circuit breaker effect from the structure (e.g., by short-circuiting) until after the emissive materials of the electrode have been activated.

In order to accomplish the above-mentioned emissive material activation, the above-described electrical shunt is short-circuited across the circuit breaker to permit current flow to the electrode. However, once the emissive materials on its electrode have been processed it is necessary to remove the electrical shunt and to reactivate the bimetal circuit breaker employed with the rapid-start fluorescent lamp.

Although such structures have been and still are employed with relatively good results, it has been found that a circuit breaker wherein an electrical shunt is required does present problems of extra materials, added labor, increased defects and reduced productivity all of which increases cost and reduces manufacturing efficiency. Moreover, lamp processing introduces numerous oxidation problems deleterious to good welding which is also a problem associated with the heat required for correct sealing of the envelope surrounding the bimetal switch configuration.

OBJECTS AND SUMMARY OF THE INVENTION

An object of the present invention is to provide an enhanced bimetal type circuit breaker. Another object of the invention is to provide an improved rapid-start fluorescent lamp. Still another object of the invention is to provide an enhanced rapid-start fluorescent lamp having increased efficiency. A further object of the invention is to provide a bimetal type circuit breaker which is simple and inexpensive to manufacture and requires neither the presence or removal of a shunting material short-circuiting the circuit breaker electrical conductors.

These, and other objects, advantages and capabilities are achieved in one aspect of the invention by a rapid-start fluorescent lamp having a glass envelope coated with phosphor and containing a fill gas with a pair of spaced electrodes therein and a pair of electrical leads sealed into the envelope and a circuit breaker therein having a glass bottle with first and second electrical conductors sealed therein and a bimetal strip having first and second end portions and an intermediate portion with the first end portion affixed to the first electrical conductor, the second end portion formed into a boot-shaped configuration having a foot member and attached leg member and an intermediate portion angularly attached to the leg member and arched to connect to the first end portion.

In another aspect, a thermally-sensitive bimetal circuit breaker includes first and second electrical conductors sealed into a glass bottle with a bimetal strip within the bottle having a first end portion affixed to the first electrical conductor, a second end portion formed into a boot-shaped configuration having a foot member and attached leg member formed for the foot member to effect edge contact with the second electrical conductor and an intermediate portion angularly attached to the leg member and arched to connect to the first end portion and effect edge contact with the second electrical conductor.

BEST MODE FOR CARRYING OUT THE INVENTION

For a better understanding of the present invention, together with other and further objects, advantages and capabilities thereof, reference is made to the following disclosure and appended claims in connection with the accompanying drawings.

Figure 1:
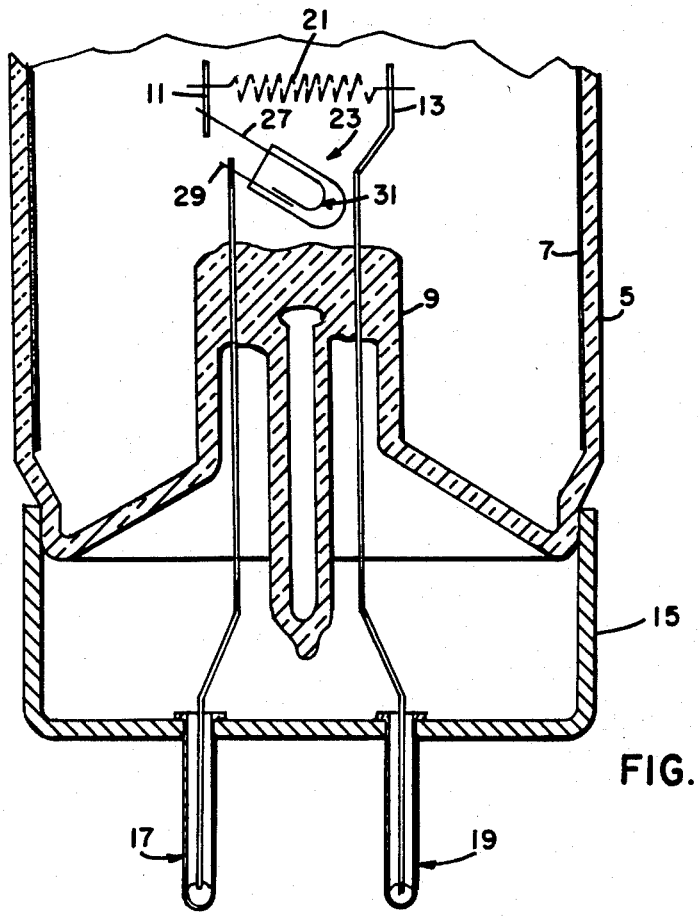
FIG. 1 is an elevational view, partially in section, of one end of a rapid-start fluorescent lamp employing a bimetal circuit breaker of the invention.

Referring to FIG. 1 of the drawings, a rapid-start fluorescent lamp includes an elongated glass envelope 5 having a coating of phosphors 7 on the inner wall surface of the envelope 5. A glass stem member 9 is sealed into the end of the envelope 5 and includes a pair of electrical leads 11 and 13 sealed therein and passing therethrough. An end cap 15 is telescoped over and attached to the end of the glass envelope 5 and includes a pair of pins 17 and 19 electrically connected to a portion of the electrical leads 11 and 13 and formed to provide electrical connection to an external source (not shown). Moreover, the envelope 5 has a gas fill therein selected from the group consisting of argon, krypton, neon, helium and combinations thereof.

An electrode 21 is located within the envelope 5 and connected at opposite ends to the electrical leads 11 and 13. Thus, the longitudinal axis of the electrode 21 is in a direction substantially normal to the direction of the electrical leads 11 and 13. Moreover, this electrode 21, which is frequently referred to as a filament or cathode, is of a well known type used in rapid start fluorescent lamps and usually includes a tungsten coil having a coating thereon in the form of alkaline earth oxides which were applied in the form of carbonates and processed to provide the oxides.

Disposed within the envelope 5 is a circuit breaker 23. The circuit breaker 23 is preferably in the form of a glass bulb or bottle 25 having a press seal at one end thereof. A pair of electrical conductors 27 and 29 are sealed into and pass through the press seal of the glass bulb 25. Also a thermally-sensitive bimetal 31 is positioned within the glass bottle 25 with one end thereof attached to one of the electrical conductors 27 and the opposite end of the bimetal 31 contacting the other electrical conductor 29. Moreover, the electrical conductors 27 and 29 extending outwardly of the glass bulb 25 are connected to the base pin 17 and to the electrical lead 11 respectively with the electrical lead 11 also connected to one end of the electrode 21.

Figure 2:
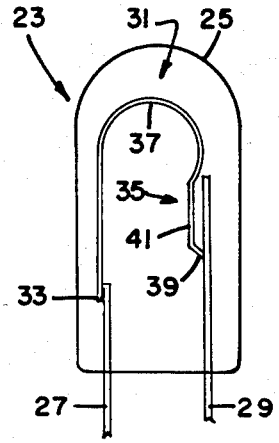
FIGS. 2–4 illustrate the operational modes of the circuit breaker of FIG. 1.
Figure 3:
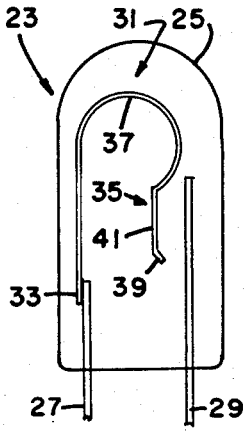
Figure 4:
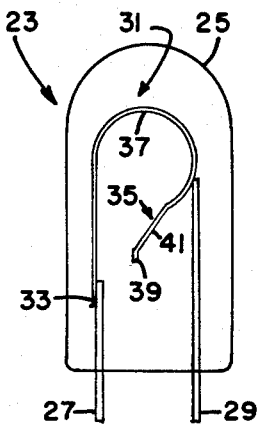

Referring to FIGS. 2–4, the circuit breaker 23 includes a glass bulb or bottle 25 with first and second electrical conductors 27 and 29 sealed therein and passing therethrough. The second electrical conductor 29 extends within the bottle 25 for a greater distance than does the first electrical conductor 27. Also, a thermally-sensitive bimetal strip 31 has first and second end portions 33 and 35 and an intermediate portion 37. Moreover, the first end portion 33 is affixed to the outermost surface of the first electrical conductor 27 and formed such that the end of the first electrical conductor 27 serves as a fulcrum for the bending of the bimetal strip 31.

The second end portion 35 of the bimetal strip 31 is in the form of a "boot" configuration having a "foot-shaped" portion 39 extending at an angle of about 45° with respect to an upstanding leg portion 41. Angularly attached to the end of the leg portion 39 and arched to the first end portion 33 is the intermediate portion 37 of the bimetal strip 31. Thus, the first end portion 33 of the bimetal strip 31 is affixed to the outermost surface or the surface of the first electrical conductor 27 furthest from the second electrical conductor 29. Accordingly, the glass bulb or bottle 25 is readily telescoped over the attached first end portion 33 and first electrical conductor 27.

As to operation, FIG. 2 illustrates a conductor wherein the bulb or bottle 25 is at an ambient temperature whereupon the foot-shaped portion 39 of the second end portion 35 of the bimetal strip 31 is in"edge" contact with the second electrical conductor 29. Also, the leg portion 41 is essentially parallel to the second electrical conductor 29 whereby the angularly attached intermediate portion 37 of the bimetal strip 31 is spaced from the second electrical conductor 29.

In FIG. 3, the bulb or glass bottle is within a given range of temperatures such as temperatures in the range of about 140° to 180° C. for example during the operational period of the lamp. At this range of bulb temperatures the second end portion 35 and the intermediate portion 37 of the bimetal strip 31 are both spaced or disengged from the second electrical conductor 29. Thus, an open-circuit condition exists between the first and second electrical conductors 27 and 29 respectively.

The temperature of the glass bulb or bottle 25 is higher or greater than the previously-mentioned given range of bulb temperatures during the manufature process. As a result, the bimetal strip 31 in FIG. 4 has an increased deformation whereupon the second end portion 35 of the bimetal strip 31 is spaced from the second electrical conductor 29. However, the angle of the angular attachement of the intermediate portion 37 of the bimetal strip 31 to the leg portion 41 of the second end portion 35 is selected such that the intermediate portion 37 is brought into "edge" contact with the second electrical conductor 29. Thus, for bulb temperatures higher than the previously-mentioned given range of bulb temperatures or for bulb temperatures of about 300° C. for example which occur during the manufacturing process, the second electrical conductor 29 and the intermediate portion 37 of the bimetal strip 31 are brought into edge contact to provide an electrical connection therebetween in order to permit current flow for activation of the emissive coating of the electrode.

In summary, at bulb temperatures higher or greater than a given range of bulb temperatures, which normally occur during the manufacturing process of the fluorescnet lamp, the bimetal strip 31 is at a maximum deflection (FIG. 4) whereupon the short-circuited first and second electrical conductors 27 and 29 permit current flow therethrough to an electrode having a potentially emissive coating such as a carbonate coating thereon. Thereupon, the carbonate coating is converted to an electron emissive oxide coating. Thus, the circuit breaker permits activation of an electrode within a fluorescent lamp during the manufacturing process.

Also, upon initial application of energy to a rapid-start fluorescent lamp, heater current flow to the electrode is necessary in order to initiate conductivity of the lamp. Accordingly, the first and second electrical conductors 27 and 29 are short-circuited (FIG. 2) at ambient bulb temperature whereupon the desired heating of the electrodes is effected.

Moreover, when the electrodes and fill gas of the rapid-start fluorescent lamp reach a temperature sufficient to establish an arc current between the electrodes therein, heating of the electrodes from an external source is no longer required or desired. Thereupon, the first and second electrodes 27 and 29 are disconnected or open-circuited by the action of the bimetal strip 31 (FIG. 3) at the given range of bulb temperatures. Thus, a reduction in energy requirements for operation of a rapid-start fluorescent lamp is achieved.

While there has been shown and described what is at present considered the preferred embodiments of the invention, it will be obvious to those skilled in the art that various modifications and changes may be made therein without departing from the invention as defined by the appended Claims.

I claim:

1. A circuit breaker for use in a rapid-start fluorescent lamp comprising:

a sealed glass bottle;

first and second electrical conductors sealed into and passing through said glass bottle; and a thermally-sensitive bimetal strip disposed within said bottle and having first and second end portions separated by an intermediate portion, said first end portion being affixed to said first electrical conductor, said second end portion being formed in a substantially boot-shaped configuration having a foot member for effecting edge contact with said second electrical conductor and a leg member extending from said foot member and said intermediate portion angularly attached to said leg member and arched to connect to said first end portion whereby said foot member and said intermediate portion are formed to establish edge contact with said second electrical conductor, said bimetal strip being formed for disengagement from said second electrical conductor at a given range of bottle temperatures and for engagement therebetween at bottle temperatures below and above said given range of bottle temperatures.

2. The circuit breaker of claim 1 wherein said foot-member is formed at an angle of about 45° with respect to said leg member.

3. The circuit breaker of claim 1 wherein said bimetal strip is formed to provide electrical engagement of said foot member and second electrical conductor at ambient bottle temperatures, disengagement of said bimetal strip and second electrical conductor at a given range of bottle temperatures and engagement of said intermediate portion of said bimetal strip and second electrical conductor at bottle temperatures higher than said given range of bottle temperatures.

4. The circuit breaker of claim 1 wherein said second electrical conductor has a mid-portion and an inner end portion and extends within said glass bottle for a distance greater than said first electrical conductor with said foot member of said bi-metal strip formed for effecting edge contact with said mid-portion of said second electrical conductor and said intermediate portion of said bimetal strip formed for effecting edge contact with said inner end portion of said second electrical conductor.

5. The circuit breaker of claim 1 wherein said first and second electrical conductors have an inner surface adjacent one another and an outer surface and said bimetal strip has a first end portion affixed to said outer surface of said first electrical conductor.

6. A rapid-start fluorescent lamp comprising:

a glass envelope having a phosphor covered inner surface;

a fill gas within said envelope;

a pair of electrical leads sealed into and passing through said envelope;

an electrode within each end of said envelope having one end thereof connected to one of said pair of electrical leads; and a circuit breaker disposed within said envelope and including a glass bottle having first and second electrical conductors sealed therein and connecting the other end of said electrode to the other one of said pair of leads, said circuit breaker having a bimetal strip with first and second end portions separated by an intermediate portion, said first end portion being affixed to said first electrical conductor, said second end portion being formed in a boot-shaped configuration with a foot member and a leg member attached thereto and said intermediate portion being angularly attached to said leg member and arched to connect to first end portion whereby said foot member effects edge contact with said second electrical conductor at a bulb tempreature below a given range of bulb temperatures, said leg member is substantially parallel to said second electrical conductor upon contact therewith of said foot member and said intermediate portion of said bimetal strip effects edge contact with said second electrical conductor at bulb temperatures higher than a said given range of bulb temperatures higher than a said given range of bulb temperatures, said bulb temperatures higher than said given range of bulb temperatures occurring during the manufacturing process of said fluorescent lamp.

7. The rapid-start fluorescent lamp of claim 6 wherein said foot member is formed at an angle of about 45° with said leg member to provide edge contact thereof with said second electrical conductor.

8. The rapid-start fluorescent lamp of claim 6 wherein said foot member contacts said second electrical conductor at ambient bottle temperature, said bimetal strip is disengaged from said second electrical conductor at a given range of bottle temperatures and said intermediate portion engages said second electrical conductor at bottle temperatures higher than said given range of bottle temperatures.

9. The rapid-start fluorescent lamp of claim 6 wherein said second electrical conductor extends into said bottle for a distance greater than said first electrical conductor and has a mid-portion and an inner end portion and said foot member is formed for effecting edge contact with said mid-portion and said intermediate portion of said bimetal is formed for effecting edge contact with said inner end portion of said second electrical conductor.

10. The rapid-start fluorescent lamp of claim 7 wherein said bimetal strip is disengaged from said second electrical conductor at bottle temperatures in the range of about 140° to 180° C. and is engaged with said second electrical conductor at bottle temperatures greater and less than said given range of bottle temperatures.

11. The rapid-start fluorescent lamp of claim 6 wherein said bimetal strip includes first and second end portions connected by an intermediate portion with said first end portion affixed to the outer side of said first electrical conductor and said second end portion and intermediate portion are arched over the end of said first electrical conductor.

* * * * *